US006270388B1

(12) United States Patent
Lee

(10) Patent No.: US 6,270,388 B1
(45) Date of Patent: Aug. 7, 2001

(54) METHOD FOR FABRICATING PARTITION OF PLASMA DISPLAY PANEL

(75) Inventor: Byung-hak Lee, Ansan (KR)

(73) Assignee: Samsung Display Devices Co., Ltd., Kyungki-do (KR)

( * ) Notice: Subject to any disclaimer, the term of this patent is extended or adjusted under 35 U.S.C. 154(b) by 0 days.

(21) Appl. No.: 09/338,379

(22) Filed: Jun. 23, 1999

(30) Foreign Application Priority Data

Sep. 11, 1998 (KR) ..... 98-37528

(51) Int. Cl.[7] ..... H01J 9/18
(52) U.S. Cl. ..... 445/24; 219/121.66
(58) Field of Search ..... 445/24, 23; 219/121.64, 219/121.66; 313/292

(56) References Cited

U.S. PATENT DOCUMENTS 4,323,756 * 4/1982 Brown et al. ..... 219/121.66
5,484,314 * 1/1996 Farnsworth ..... 445/24
5,578,227 * 11/1996 Rabinovich ..... 219/121.64
5,580,472 * 12/1996 Maybon ..... 219/121.66
5,883,462 * 3/1999 Ushifuss et al. ..... 313/292
6,124,916 * 9/2000 Park et al. ..... 445/24

* cited by examiner

*Primary Examiner*—Kenneth J. Ramsey
*Assistant Examiner*—Todd R Hopper
(74) *Attorney, Agent, or Firm*—Lowe Hauptman Gilman & Berner, LLP

(57) ABSTRACT

A method for fabricating a partition of a plasma display panel includes the steps of spraying and coating a powdered partition material onto a substrate on which address electrodes and a dielectric layer are formed, melting the partition material by a laser beam, and solidifying the melted partition material to complete the partition.

2 Claims, 3 Drawing Sheets

METHOD FOR FABRICATING PARTITION OF PLASMA DISPLAY PANEL

BACKGROUND OF THE INVENTION

1. Field of the Invention

The present invention relates to a method for fabricating a partition of a plasma display panel, and more particularly, to a method for fabricating a partition directly on a substrate using a laser beam.

2. Description of the Related Art

A plasma display panel produces a luminous discharge by electrically discharging a gas sealed between two electrodes, and forms a picture image by exciting a phosphor layer with ultraviolet rays generated during the luminous discharge.

Referring to FIG. 1 illustrating an example of a conventional plasma display panel, transparent electrodes 12 are formed in strips on the lower surface of a front substrate 11, and bus electrodes 13 whose widths are narrower than those of the transparent electrodes 12 are formed on the transparent electrodes 12. Also, a black matrix 16 is formed between neighboring transparent electrodes 12 for preventing optical crosstalk between neighboring pixels and increasing contrast.

A transparent dielectric layer 14 is formed on the lower surface of the front substrate 11 to cover the transparent electrodes 12.

A protective layer 15 made of magnesium oxide (MgO) is deposited on the lower surface of the transparent dielectric layer 14.

Address electrodes 17 are formed on a rear substrate 19 coupled to the side facing the front substrate 11 so as to be perpendicular to the transparent electrodes 12. The address electrodes 17 are covered by a dielectric layer 20 coated on the rear substrate 19.

Partitions 18 are formed on the dielectric layer 20 to define a discharge space. The partitions 18 prevent optical crosstalk between neighboring discharge cells.

A method for fabricating the partitions 18 in the plasma display panel will be described with reference to FIG. 2.

First, a partition material is coated onto the entire dielectric layer 20 formed on the rear substrate 17 so as to cover the address electrodes 17. Next, the partition material is cut by laser to complete the partitions 18.

However, according to the conventional partition fabrication method, there is a considerable loss of the partition material. Also, since the partition material must be cut after it is coated, much time is required to do so.

SUMMARY OF THE INVENTION

To solve the above problems, it is an object of the present invention to provide a method for fabricating a partition of a plasma display panel by which the partition can be simply fabricated without loss of a partition material, by directly coating the partition material onto a substrate.

Accordingly, to achieve the above object, there is provided a method for fabricating a partition of a plasma display panel including the steps of spraying and coating a powdered partition material onto a substrate on which address electrodes and a dielectric layer are formed, melting the partition material by a laser beam, and solidifying the melted partition material to complete the partition.

Also, coating, melting and solidifying of the partition material are continuously performed in a direction along which the partition is to be formed.

BRIEF DESCRIPTION OF THE DRAWINGS

The above object and advantages of the present invention will become more apparent by describing in detail a preferred embodiment thereof with reference to the attached drawings in which.

DESCRIPTION OF THE PREFERRED EMBODIMENT

Hereinbelow, a method for fabricating a partition of a plasma display panel according to a preferred embodiment of the present invention will be described with reference to FIGS. 3 through 7.

Figure 1A:
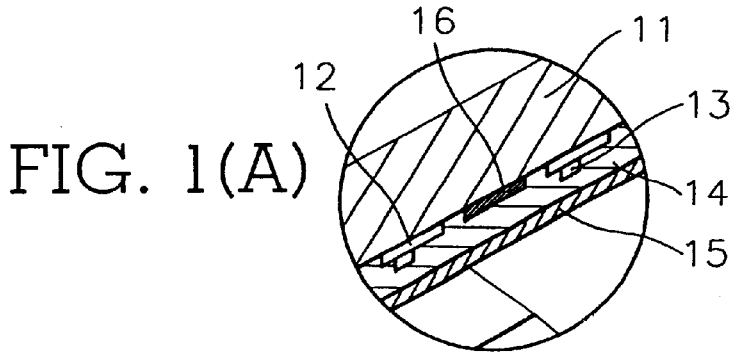
FIG. 1 is a perspective view of a conventional plasma display panel.
Figure 1:
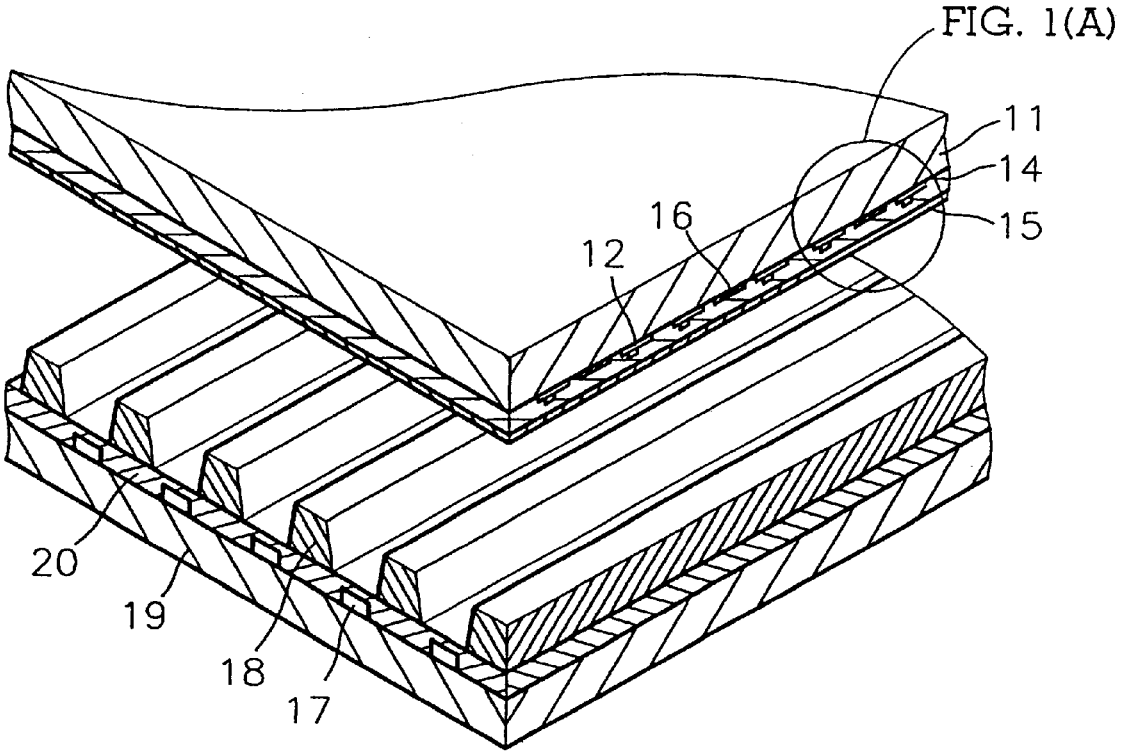
FIG. 1 (PRIOR ART)
Figure 2:
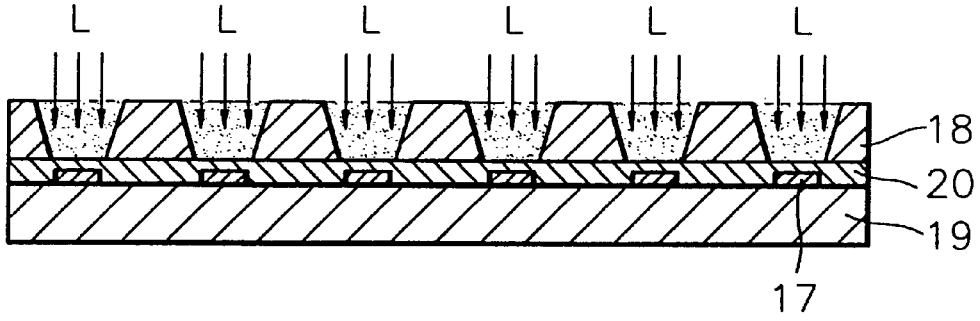
FIG. 2 (PRIOR ART)
FIG. 2 is a cross-sectional view illustrating a method for fabricating a partition of the conventional plasma display panel.
Figure 3:
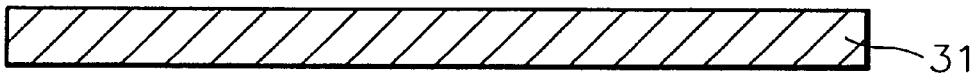
FIGS. 3 through 7 are cross-sectional views illustrating a method for fabricating a partition of a plasma display panel according to the present invention.

First, as shown in FIG. 3, a substrate 31 on which partitions are to be formed is prepared. The surface of the substrate 31 is degreased in a typical manner.

Figure 4:
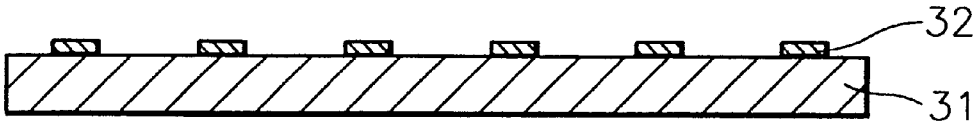

Then, as shown in FIG. 4, a plurality of address electrodes 32 are formed on the upper surface of the substrate 31 by a well-known method, preferably a printing method.

Figure 5:
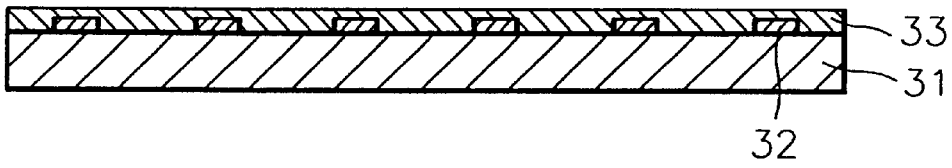

As shown in FIG. 5, a dielectric layer 33 is coated onto the substrate 31 to cover the address electrodes 32. The dielectric layer 33, an insulation material, is dried and cured.

Figure 6:
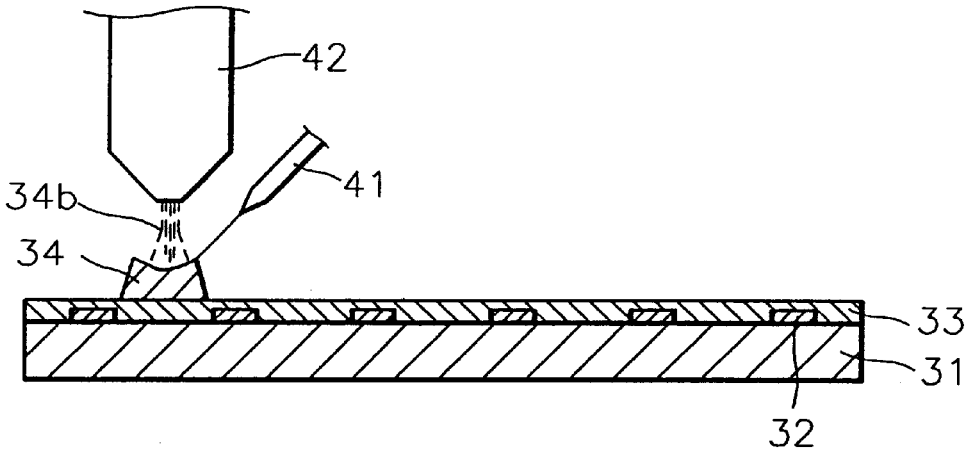
Figure 7:
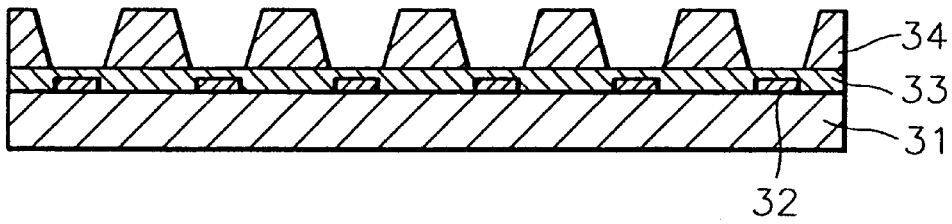

Subsequently, as shown in FIG. 6, a potential partition 34*a* is formed on the dielectric layer 33. The partition 34*a* is formed by spraying a partition material 34*b* by a supplier 42. The partition material 34*b* is generally in the form of powder. The partition material 34*b* sprayed by the supplier 42 is melted by a laser beam irradiated from a laser generator 41, deposited on the dielectric layer 33 and then solidified.

Now, the process of completing the partition 34*a* on the dielectric layer 33 will be described in more detail. During this process, the partition material 34*b* in the form of powder, the laser generator 41 for melting the powder and the supplier 42 for supplying the powder are used. The powder is supplied over the dielectric layer 33 in the form of a partition using the supplier 42 and the shape of a partition is formed on the dielectric layer 33. Thereafter, the powdered partition material 34*b* is melted by a laser beam irradiated from the laser generator 41 to then be solidified, thereby completing the partition 34*a*. Alternatively, the processes of spraying a predetermined amount of the powder as the partition material 34*b* over the dielectric layer 33 and melting the powder by irradiating a laser beam thereon are repeatedly performed, thereby completing the partition 34*a*.

The supplier 42 and the laser generator 41 build the partition 34 while moving lengthwise to the partition 34.

Alternatively, a plurality of partitions 34 may be simultaneously formed by providing a plurality of suppliers 42 and laser generators 41.

In the method for fabricating a partition of a plasma display panel according to the present invention, since a partition material is supplied by a supplier and simultaneously a partition is formed by a laser generator, it is simple to fabricate the partition. Also, since loss of the partition material is not considerable, the partition fabrication method is very economical.

What is claimed is:

1. A method for fabricating a partition of a plasma display panel comprising the steps of:

spraying and coating a powdered partition material onto a substrate on which address electrodes and a dielectric layer are formed;

melting the partition material by a laser beam; and solidifying the melted partition material to complete the partition.

2. The method according to claim 1, wherein coating, melting and solidifying of the partition material are continuously performed in a direction along which the partition is to be formed.

* * * * *